United States Patent [19]

Paulitz et al.

[11] Patent Number: 4,584,141

[45] Date of Patent: Apr. 22, 1986

[54] PROCESS RELATING TO TRIGLYCERIDE OILS

[75] Inventors: Bernhard G. A. Paulitz, Weinheim, Fed. Rep. of Germany; Jacobus C. Segers, Nieuwerkerk a/d IJssel; Albert J. Spits, Oudenbosch, both of Netherlands

[73] Assignee: Internationale Octrooi Maatschappij "Octropa" B.V., Rotterdam, Netherlands

[21] Appl. No.: 586,958

[22] Filed: Mar. 7, 1984

[30] Foreign Application Priority Data

Mar. 18, 1983 [GB] United Kingdom ..... 8307594

[51] Int. Cl.[4] ..... C11C 1/08; C11C 3/00

[52] U.S. Cl. ..... 260/420; 260/403; 260/424; 435/128

[58] Field of Search ..... 260/403, 420, 424; 435/128

[56] References Cited

U.S. PATENT DOCUMENTS

| | | | |
|---|---|---|---|
| 1,607,459 | 11/1926 | Johannsen et al. | 568/899 |
| 2,663,717 | 12/1953 | Strezynski et al. | 260/412 |
| 3,134,794 | 5/1964 | Myers | 260/403 |
| 3,823,170 | 7/1974 | Seaberg et al. | 260/403 |
| 4,049,686 | 9/1977 | Ringers et al. | 260/420 |
| 4,162,260 | 7/1979 | Segers | 260/428.5 |
| 4,424,388 | 1/1984 | Braithwaite et al. | 568/899 |

FOREIGN PATENT DOCUMENTS

| | | | |
|---|---|---|---|
| 481580 | 6/1936 | United Kingdom | 260/420 |
| 526852 | 9/1940 | United Kingdom . | |
| 766394 | 1/1957 | United Kingdom . | |
| 764833 | 1/1957 | United Kingdom . | |
| 1055746 | 1/1967 | United Kingdom . | |
| 1145293 | 3/1969 | United Kingdom . | |
| 1194915 | 6/1970 | United Kingdom . | |
| 1211814 | 11/1970 | United Kingdom . | |
| 1285644 | 8/1972 | United Kingdom . | |
| 1334517 | 10/1973 | United Kingdom . | |
| 1350390 | 4/1974 | United Kingdom . | |
| 1504125 | 3/1978 | United Kingdom . | |
| 1541017 | 2/1979 | United Kingdom . | |
| 2023120 | 12/1979 | United Kingdom . | |
| 2005717 | 6/1982 | United Kingdom . | |

*Primary Examiner*—J. E. Evans

*Attorney, Agent, or Firm*—Cushman, Darby & Cushman

[57] ABSTRACT

The present process for removing impurities from a triglyceride oil includes admixing a hydrolyzed phosphatide and water with the oil, separating the oil into an oil portion and a sludge portion and separating the sludge portion into an aqueous phase and an oil phase. The presence of the hydrolyzed phosphatides can aid the two separation steps. Recovery of oil from the sludge is thus possible.

25 Claims, No Drawings

PROCESS RELATING TO TRIGLYCERIDE OILS

The present invention relates to a process for removing impurities from triglyceride oils and to triglyceride oils and other products so obtained.

Triglyceride oils are a valuable raw material. They consist mainly of triglycerides of fatty acids but usually contain minor components such as colouring materials, sugars, glucosides, waxes, ffa, metals and phosphatides. Some of these minor components are preferably removed in smaller or larger amounts. A particularly important and valuable group of the minor components is formed by the phosphatides.

"Degumming" is the name given to processes in which inter alia phosphatides are removed from triglyceride oil. A simple degumming process comprises merely admixing water with the triglyceride oil and separating the resulting mixture into an oil component and an aqueous component containing inter alia some of the gums or phosphatides. An example of such a process is given in CA 522398 in which a water degumming process for rice bran oil is described. Rice bran oil contains a high proportion of waxes and the process described in CA 522398 comprises heating the oil/water mixture to hydrate the gums and then slowly cooling the mixture to allow wax crystals to coalesce and so be separated with the aqueous component. Reheating of the separated aqueous or sludge component is said to permit extraction of the waxes as well as entrained oil.

Phosphatides present in crude triglyceride oils can however be distinguished into two classes: the hydratable and the non-hydratable phosphatides. Simple water degumming may remove the first class viz hydratable phosphatides, but not the second class. The removal of the non-hydratable phosphatides has traditionally been a great problem.

In a conventional degumming process, designed to remove inter alia non-hydratable phosphatides from the oil, the crude oil is first treated with $H_2O$ to hydrate hydratable phosphatides, which form a sludge which subsequently can be removed by for example centrifugal separation. To this predeslimed oil which usually still contains about 0.5% of non-hydratable phosphatides, is added for example phosphoric acid which serves to convert the non-hydratable phosphatides into hydratable ones. Subsequently, an aqueous alkali hydroxide solution is added to remove the phosphatides and to neutralise the free fatty acids. Thereafter the soapstock so formed is separated from the neutralised oil by centrifugal separation. Subsequently the oil is usually bleached with a bleaching earth and deodorised by steamstripping.

The above described process has a number of disadvantages. In the neutralisation step an extra amount of alkali is needed to neutralise the $H_3PO_4$ which was previously added. Additionally Ca and Mg salts from the non-hydratable phosphatides can cause a quick fouling of the centrifuges used to separate the soapstock from the oil. Therefore the centrifuges have to be cleaned frequently which leads to production losses. Oil losses also exist due to oil entrainment with the sludge. The phosphatides, sugars, glycerol and other minor components removed can moreover get into the soapstock, which can cause difficulties in the soapsplitting process and can also contaminate the aqueous phase from these processes with organic material.

An attempt to overcome some of these disadvantages is described in U.S. Pat. No. 4,162,260 in which it is proposed to remove impurities from a triglyceride oil by increasing the level of hydratable phosphatides prior to degumming. The addition of between about 0.01 and 5 wt % with respect to the oil of hydratable phosphatide is said to aid the removal of not only non-hydratable phosphatides but also other impurities such as sugars, sterol glucosides, glycerol, proteins, waxes etc present in the oil. The type of degumming process elected will depend inter alia on the amount of non-hydratable phosphatide present in the oil. With oils containing none or only a very low amount of non-hydratable phosphatides like palm oil, palm kernel oil or coconut oil it is preferred to remove the added hydratable phosphatides by a simple water-degumming step. For oils however containing non-hydratable phosphatides such as soyabean oil, sunflower oil, rapeseed oil and linseed oil it is preferred to employ a degumming process such as that described in U.S. Pat. No. 4,049,686.

U.S. Pat. No. 4,049,686 describes the use of a concentrated acid or anhydride for converting non-hydratable phosphatides into hydratable phosphatides. After treatment of the oil with said acids or anhydrides subsequently 0.2 to 5% by weight of water is dispersed in the mixture obtained. The mixture of oil, acid or anhydride and water is maintained for at least 5 minutes at a temperature below 40° C. After this treatment the formed aqueous sludge can be separated by for example centrifugation. Separation at a low temperature e.g. below 40° C., however, causes inclusion of more oil by the hydrated phosphatides structure than in case that the separation is performed at a temperature above 40° C. and involves the risk that, e.g. polar types of phosphatides and solidified waxes etc. may impede the action of the centrifuge. Therefore to keep the oil losses and other production difficulties as low as possible the separation is carried out in many cases by heating the mixture to a temperature in the range of 60° to 90° C. followed by immediate centrifugation of the mixture. However, in some cases this heating before the separation is not desirable for instance where compounds such as waxes, glucosides, and some polar types of phosphatides have to be removed from the oil. These components dissolve or melt very quickly in the oil when the mixture is heated to a temperature above 40° C. If a highly purified oil is desired one has therefore to accept a maximum separation temperature of 40° C. and hence higher oil losses and additional possible operating problems.

A problem thus exists in oil refining processes such as degumming processes due inter alia to oil loss by entrainment in the sludge. The problem is particularly acute when a low separation temperature is employed to obtain a high grade oil.

According to a first aspect of the present invention there is provided a process for removing impurities from a triglyceride oil including admixing a hydrolysed phosphatide and water with the oil, separating the oil into an oil portion and a sludge portion and separating the sludge portion into an aqueous phase and an oil phase.

The composition of the sludge portion will depend on the source of the triglyceride oil. It may however contain inter alia one or more of entrained oil, waxes, gums, glucosides, polar phosphatides and the like and water. The sludge may moreover contain in solid form high melting point triglycerides whether present naturally in the crude oil or selectively induced by for example hardening. We have found that the use of hydrolysed phosphatide can aid the separation of a sludge portion containing for example solid waxes by maintaining such waxes in dispersion and can increase the amount of for example polar phosphatides separated in the sludge portion. The capability of improved separation of a sludge portion containing waxes can thus ameliorate some of the problems encountered in wax-containing oils. The present process can thus be suitable for separating the oil into an oil portion and a sludge portion at a temperature below 50° C., suitably below 40° C., more suitably below 25° C. or even 10° C. A minimum temperature may be set by the confines of the system but will preferably not be below −5° C.

Separation of the sludge portion into an aqueous phase and an oil phase can allow at least partial recovery of oil entrained in the sludge portion to be achieved and can be aided by the presence of the hydrolysed phosphatide. The oil phase will comprise oil and may include oil soluble materials such as waxes and entrained water and lecithins. Conversely the aqueous phase will comprise water and may include lecithins and entrained oil and oil-soluble materials.

The presence of the hydrolysed phosphatide can moreover reduce the amount of lecithin contained in the oil phase and the amount of oil contained in the aqueous phase. For example a lecithin containing aqueous phase cna be obtained containing less than about 25 wt %, even less than 20 wt %, oil and an oil phase can be obtained containing less than about 2000 ppm P, preferably less than 1000 ppm P, more preferably less than 500 ppm P.

Preferably an oil phase is separated from the sludge portion by maintaining the sludge portion at ambient temperature for about 1 to about 120 hours so as to allow an oil phase to exude from the sludge portion. Alternatively an oil phase may be separated from the sludge portion by maintaining the sludge portion at a temperature between 50° and 120° C., preferably at a temperature between 80° and 120° C. Suitably the sludge portion is raised in temperature by passage through a heat exchanger for example a plate heat exchanger or a tube heat exchanger or by use of microwave heating. When microwave heating is employed it may be possible to use temperatures below 50° C. for example from 40° to 50° C. Preferably the sludge portion, whether maintained at ambient temperature or a raised temperature, is passed through pipe means under laminar flow. Separation of the sludge portion into an oil phase and an aqueous phase can thus be, and most preferably is effected in the absence of an added solvent. Suitably the viscosity of the sludge portion can be, if necessary, reduced by admixing with a sample of the triglyceride oil. Appropriate proportions range from 10:1 to 1:10 of oil to sludge portion respectively.

Preferably the sludge portion is separated into an oil phase and aqueous phase centrifugally. Alternatively settling may be employed. Optionally the sludge portion can be dried to a water content of less than 1 wt % and subsequently rehydrated prior to separation into an oil phase and an aqueous phase.

The amount of hydrolysed phosphatide admixed with the oil will depend inter alia on the composition of the oil. Preferably however 0.01 to 15 wt %, with respect to the oil, hydrolysed phosphatide is admixed with oil. More preferably 0.2 to 5 wt % hydrolysed phosphatide is admixed with the oil. The hydrolysed phosphatide may either be admixed with the oil in dry form or alternatively in hydrated form.

The amount of water admixed with the oil may range from for example 0.01 to 15 wt % with respect to the oil. The water may be admixed with the oil before or after the hydrolysed phosphatide is admixed with the oil. Alternatively a part of the water may be admixed before and a part after the hydrolysed phosphatide is admixed with the oil. Where the hydrolysed phosphatide is admixed in hydrated form at least a part of the water is used to hydrate the hydrolysed phosphatide and will therefore be added with the hydrolysed phosphatide. When the hydrolysed phosphatide is admixed in a hydrated form it is preferably admixed with the oil by means of a dynamic mixer for example a centrifugal pump. Where the hydrolysed phosphatide is admixed in dry form, the water is preferably admixed with the oil after the admixture of the hydrolysed phosphatide with the oil.

By "hydrolysed phosphatide" we mean a phosphatide which has been at least partially hydrolysed. Suitably the phosphatide is between 20 and 80 wt % hydrolysed. Hydrolysed phosphatide may moreover be employed which has been hydroxylated, acylated or otherwise modified. Fractionated hydrolysed phosphatides, hydrolysed fractions of phosphatides or synthetic hydrolysed phosphatides may be employed.

The phosphatides which are hydrolysed for use in the present invention may be obtained from natural sources such as vegetable triglyceride oils or egg yolk. Hydrolysis may be performed in for example acidic or basic conditions or enzymatically.

The hydrolysed phosphatide may be purchased. Examples of commercially available hydrolysed phosphatides are Bolec K and Solec K which are phosphatides obtained from soyabean and sunflower oils respectively each of which has been enzymatically hydrolysed by about 45 to 55%.

Where a triglyceride oil employed in the present process contains gums the oil is suitably degummed. Degumming may occur due to the admixture of the hydrolysed phosphatide and water and subsequent separation into an oil portion and a sludge portion which will then contain inter alia the gums, e.g. lecithin. Particular degumming techniques such as that described in U.S. Pat. No. 4,049,686 may however be applied. In such a case the hydrolysed phosphatide may be added before, during or after the acid or anhydride and water have been added. The technique described in U.S. Pat. No. 4,049,686 can be particularly appropriate where the oil is separated into an oil portion and a sludge portion at a temperature below 50° C.

When an aqueous phase containing lecithin is produced the aqueous phase may be dried to a water content of less than 1 wt % to yield as a valuable by-product of the process a lecithin. In particular a lecithin may be obtained having an oil content of less than 25 wt %, more particularly less than 20 wt %.

Where the oil is degummed as part of the present process so that the sludge portion contains lecithin an alternative to the purchase of commercial hydrolysed phosphatides is available. Such an alternative can allow the preparation of hydrolysed phosphatide at low cost and can moreover provide a hydrolysed phosphatide having identical characteristics to the triglyceride oil to which it is to be added.

A sludge portion containing lecithin and/or an aqueous phase containing lecithin, either of which may be employed directly or may have been dried and stored and subsequently rehydrated, may be subjected to acid, base or enzyme hydrolysis to yield hydrolysed phosphatide for use in the present process. In the case of enzymic hydrolysis the temperature of the sludge portion or the aqueous phase is preferably adjusted to between about 50° C. and 90° C., preferably about 70° C., and its pH preferably raised, suitably by the addition of ammonia, to preferably about 7 to 9. The sludge portion or aqueous phase is then brought into contact with a solution containing a phospholypase A2 and mixed thoroughly therewith. The mixture is retained for a sufficient period of time such as between 2 and 20 hours for example 12 hours to allow the phospholypase to act, for example by passage through a residence time vessel. In the case of hydrolysis of the aqueous phase the hydrolysed lecithin may be admixed directly with the oil or alternatively it may be dried to a water content of less than 1 wt % and admixed in a dry form with the oil or rehydrated prior to use. When added in a hydrated form the hydrolysed lecithin is preferably admixed with the oil by the use of a dynamic mixer. We have found by experience that the mixing provided by a dynamic mixer such as a centrifugal pump is preferable to achieve appropriate dispersion of the hydrolysed lecithin. In the case of hydrolysis of the sludge portion, the sludge portion is subsequently separated into an oil phase and an aqueous phase containing the hydrolysed lecithin which may then be treated as the hydrolysed aqueous phase above.

The oil phase separated from the sludge portion may be sold or used or alternatively waxes in it may be extracted in a known manner. Depending on the crude triglyceride oil, the oil phase may have a wax content of from about 1 to 25 wt %, more particularly from 2 to 10 wt %, and a phosphatide content of from about 50 to 2000 ppm P with respect to triglyceride oil present.

It is to be understood that the present invention extends to the products of the present processes, in particular to the oil portion and the oil phase and to the aqueous phase in a dried form and a dried and hydrolysed lecithin composition derived from the sludge portion or the aqueous phase.

The present process can be applicable to a triglyceride oil containing as impurities one or more of waxes, polar or other phosphatides, glucosides, gums or high melting triglycerides. Examples of such oils include sunflower oil, safflower oil, soyabean oil, cottonseed oil, grapeseed oil, corn oil, rapeseed oil, rice bran oil, tallow and fish oil and mixtures thereof.

Embodiments of the present invention will now be described by way of example only:

EXAMPLE 1

Crude sunflower oil having a wax content of 1150 ppm and a lecithin content of 0.56 wt % was degummed by the following procedure. The oil was admixed at 70° C. with 0.6% hydrolysed soyabean lecithin. 0.045 wt % citric acid dissolved in its own weight of water was added to the oil-lecithin mixture. The temperature of the resulting mixture was reduced to 15° C., 1.0 wt % distilled water added, and the resulting mixture maintained at 15° C. for at least 30 minutes. Centrifugal separation was readily carried out at 15° C. and yielded a high grade refined sunflower oil having a P content of 22 ppm and a wax content of less than 50 ppm, and a sludge. A portion of the sludge was dried and on analysis comprised about 51.8 wt % entrained oil, 47.9 wt % lecithin and 0.3 wt % water. The oil content of the sludge represented about a 1 wt % oil loss with respect to the crude sunflower oil.

The undried portion of the sludge was passed through a tubular heat exchanger to raise its temperature to about 85° C. and then subjected to centrifugal separation. The centrifuge yielded an oil phase with a melting point of 64.2° C. containing about 11 wt % wax, 0.46 wt % water, 1.97 wt % free fatty acid and 108 ppm P. The aqueous phase was dried and comprised 0.3 wt % water, 80.1 wt % lecithin and 19.6 wt % oil. The separated oil phase amounted to about 75 wt % of the oil initially entrained in the sludge.

The lecithin containing aqueous phase was subjected to the following procedure. Its pH was raised to 8 by addition of ammonia hydroxide solution. Subsequently 0.15 wt % pancreatin, calculated with respect to the lecithin content of the aqueous phase, in aqueous solution was added to and thoroughly mixed with the lecithin containing phase. The mixture was retained in a residence vessel for 12 hours to allow enzyme hydrolysis of the lecithin to occur.

The hydrolysed lecithin containing phase without further treatment was available for addition to the crude sunflower oil in place of the soyabean lecithin. A continuous degumming process for crude sunflower oil was performed successfully employing the so-produced hydrolysed sunflower lecithin. The amount of lecithin containing aqueous phase subjected to enzyme hydrolysis was adjusted to supply the necessary amounts of hydrolysed lecithin for adding to the crude oil. Excess lecithin containing aqueous phase was dried to provide a valuable by-product. The hydrolysed lecithin composition was admixed with crude oil by means of a dynamic mixer.

EXAMPLE 2

Crude soyabean oil having a P-content of 1000 ppm, 0.9% ffa-content, 0.09% water content and 110 ppm Ca and 145 ppm Mg was degummed by the following procedures. Part of the oil was admixed at 70° C. with 0.04 wt % citric acid dissolved in its own weight of distilled water. In the other part of the soybean oil 0.3 wt % of hydrolysed soybean lecithin was dissolved at 70° C. prior to admixing with 0.04 wt % citric acid dissolved in its own weight of distilled water. Each of the resulting mixtures was stirred for 10 minutes at 70° C. and was then cooled to 24° C. To each mixture 2.25 wt % cold distilled water was added slowly. Both mixtures were then maintained at 24° C. for 2 to 3.5 hours with slow stirring.

Each mixture was then split into two portions, from both of which a sludge was separated, but at different temperatures. The sludges were readily separated from the oils centrifugally by means of a pilot scale bowl and disc centrifuge. The temperatures applied to each portion of each mixture were 65° C. and 25° C. respectively.

The results in terms of residual P content remaining in the oil and oil entrained with the sludge are given in Table I.

TABLE I

| Hydrolysed Lecithin | Centrifugation Temperature (°C.) | Residual P content in oil (ppm) | Oil content in dried sludge (% wt) |
|---|---|---|---|
| No | 65 | 70 | 36 |
| No | 25 | 24 | 55 |
| Yes | 65 | 35 | 35 |
| Yes | 25 | 11 | 55 |

The results show that the presence of hydrolysed lecithin reduces the amount of polar phosphatides remaining in the oil. The lowest amount of residual phosphatides is attained on use of the lower separation temperature. To offset the otherwise higher oil loss due to greater entrainment of the oil in the sludge at the lower separation temperature, the sludges were treated.

The two sludges obtained from the 25° C. centrifugations were heated at 90° C. for 165 minutes using a drying cabinet. Removal of the exuded oil was achieved by centrifugation during 10 minutes at 2000 g acceleration.

The separated aqueous phases were dried and assessed for oil content. The aqueous phase originating from the oil to which no hydrolysed lecithin had been added contained 32 wt % oil, whilst the aqueous phase originating from the oil to which hydrolysed lecithin had been added contained 29 wt % oil.

EXAMPLE 3

With sludge obtained from the degumming of soybean oil with addition of 0.3 wt % of hydrolysed lecithin and 0.04 wt % of citric acid as described in Example 2 and obtained after centrifugation at 25° C. a de-oiling technique was performed by applying microwave heating for a very short period of time of less than 120 s. By centrifugation as described in Example 4 the oil content of the sludge after drying was decreased from 55 wt % to 20 wt %.

EXAMPLE 4

With a sludge as used in Example 2 a de-oiling was carried out without applying a heat treatment, but by maintaining the sludge for 5 days at room temperature of approx. 25° C. After centrifugation the oil content of the dried sludge turned out to be decreased from 55 wt % to 21 wt %.

EXAMPLE 5

Crude sunflower oil was degummed by the following procedure.

0.06 wt % citric acid, with respect to the oil, as a 1:1 aqueous solution was added to the oil at a temperature of 70° C. The mixture was cooled to 12° C. 1.8 wt % water, with respect to the oil, was admixed with the oil mixture followed by the admixture of 0.8% hydrolysed phosphatide, with respect to the oil, by means of a centrifugal pump. The hydrolysed phosphatide was added in the form of a hydrated hydrolysed lecithin which had been obtained enzymatically by the method described in Example 1. To contribute 0.8% hydrolysed phosphatide about 2 wt % of the hydrated hydrolysed lecithin in the form of a paste was required. The resulting oil mixture was maintained at 15° C. for about 2 hours. The mixture, still at 15° C., was then readily centrifuged into an oil portion and a sludge portion.

On analysis the sludge portion had an oil content of 54.2 wt %.

The sludge was divided into five batches. Each batch was separated into an aqueous phase and an oil phase by heating it to 60° C., 70° C., 80° C., 90° C. and 100° C. respectively by passage through a tubular heat exchanger and maintaining it at that temperature for about 2 minutes. Each batch was then centrifuged. Each resulting aqueous lecithin phase was analysed for its oil content and each oil wax phase for its P content. The results are given in Table II.

TABLE II

| Temperature (°C.) | 60 | 70 | 80 | 90 | 100 |
|---|---|---|---|---|---|
| Oil content in aqueous/lecithin phase (% wt) | 46.1 | 42.7 | 34.5 | 23.7 | 19.3 |
| P-content in oil/wax phase (% wt) | 1820 | 781 | 646 | 436 | 325 |

The results show that useful separation takes place at 60° C. and that as the separation temperature is increased the separation of the wax/oil phase from the lecithin phase and of the lecithin from the wax/oil phase becomes greater. Particularly noteworthy is the increased separation of the phosphatides from the oil phase at the higher temperatures.

EXAMPLE 6

Samples of the sludge portion obtained by the degumming technique described in Example 5 were treated as follows.

Two samples were maintained at 70° C. for 1 and 4 hours respectively and two samples at 90° C. for 1 and 4 hours respectively. The sludge portion was then separated in each case into an oil phase and an aqueous phase centrifugally at 1000 rpm for 10 minutes. The results in terms of % oil recovery from oil contained in the sludge are given in Table III.

TABLE III

| Time (h) | Temperature (°C.) | Oil recovery (%) |
|---|---|---|
| 1 | 70 | 53 |
| 4 | 70 | 50 |
| 1 | 90 | 74 |
| 4 | 90 | 82 |

Three samples of the sludge were subjected to microwave treatment. The samples were heated to 41° C., 66° C. and 84° C. in 5, 15 and 45 sec respectively. The resulting sludges were separated centrifugally at 1000 rpm for 10 minutes into an oil phase and an aqueous phase. The results in terms of % oil recovered from the oil content of the original sludge are given in Table IV.

TABLE IV

| Time (s) | Temperature (°C.) | Oil recovery (%) |
|---|---|---|
| 5 | 41 | 43 |
| 15 | 66 | 45 |
| 45 | 84 | 59 |

EXAMPLE 7

To soyabean oil at 70° C. was added 0.5 wt % of commercially available hydrolysed soyabean lecithin in dry form and mixed therewith. Next 0.07 wt % citric acid as a 1:1 aqueous solution was mixed with the oil and the oil held at 70° C. for 10 minutes. The resulting mixture was cooled to 25° C. 2 wt % water was admixed with the oil and the resulting mixture held at 25° C. for 4 hours. The mixture was then heated to 70° C. and immediately centrifuged to yield an oil portion and a sludge portion.

The sludge portion had the following composition: 26 wt % water, 31% oil and 43% phosphatides.

Samples of the sludge portion were separated into an oil phase and an aqueous phase by, as in Example 6, maintaining two samples at 70° C. for 1 and 4 hours respectively and two samples at 90° C. for 1 and 4 hours respectively and centrifuging each sample at 1000 rpm for 10 minutes. The results in terms of % oil recovery from oil contained in the sludge are given in Table V.

TABLE V

| Time (h) | Temperature (°C.) | Oil recovery (%) |
|---|---|---|
| 1 | 70 | 13 |
| 4 | 70 | 16 |
| 1 | 90 | 39 |
| 4 | 90 | 36 |

Three samples of sludge were subjected to microwave treatment. The three samples were heated to 45° C., 59° C. and 80° C. in 5, 15 and 45 s respectively. Each sludge was separated into an oil phase and an aqueous phase by centrifuging for 10 mins at 1000 rpm. The results in terms of % oil recovery are given in Table VI.

TABLE VI

| Time (s) | Temperature (°C.) | Oil recovery (%) |
|---|---|---|
| 5 | 45 | 27 |
| 15 | 59 | 34 |
| 45 | 80 | 48 |

We claim:

1. Process for removing impurities from a triglyceride oil including admixing a hydrolysed phosphatide and water with the impure oil, separating the thus treated oil at a temperature below 50° C. into a purified oil portion and a sludge portion and thereafter separating the sludge portion at a temperature from ambient temperature to 120° C. into an aqueous phase and an oil phase, the oil phase containing additional triglyceride oil in purified form.

2. Process according to claim 1 wherein the oil is separated into an oil portion and a sludge portion at a temperature below 25° C.

3. Process according to claim 2 wherein the oil is separated into an oil portion and a sludge portion at a temperature below 10° C.

4. Process according to claim 1 wherein the oil phase is separated from the sludge portion by maintaining the sludge portion at ambient temperature for about 1 to about 120 hours so as to allow an oil phase to exude from the sludge portion.

5. Process according to claim 1 wherein the oil phase is separated from the sludge portion by maintaining the sludge portion at a temperature between 40° and 120° C.

6. Process according to claim 5 wherein the oil phase is separated from the sludge portion by maintaining the sludge portion at a temperature between 80° and 120° C.

7. Process according to claim 5 wherein the sludge portion is raised in temperature by passage through a heat exchanger or by use of microwave heating.

8. Process according to claim 4 or claim 5 wherein the sludge portion is passed through pipe means under laminar flow conditions.

9. Process according to claim 1 wherein the sludge portion is separated centrifugally into an oil phase and an aqueous phase.

10. Process according to claim 1 wherein 0.01 to 15 wt % hydrolysed phosphatide with respect to the oil is admixed with the oil.

11. Process according to claim 10 wherein 0.2 to 5 wt % hydrolysed phosphatide with respect to the oil is admixed with the oil.

12. Process according to claim 1 wherein the hydrolysed phosphatide is admixed with triglyceride oil in dry form or in hydrated form.

13. Process according to claim 1 wherein the hydrolysed phosphatide is admixed with the oil by means of a dynamic mixer.

14. Process according to claim 1 wherein 0.01 to 15 wt % water is admixed with the triglyceride oil.

15. Process according to claim 1 wherein the sludge portion is dried and subsequently rehydrated prior to separation into an oil phase and an aqueous phase.

16. Process according to claim 1 wherein triglyceride oil is admixed with the sludge portion prior to separation into an oil phase and an aqueous phase.

17. Process according to claim 1 wherein the oil is degummed.

18. Process according to claim 17 wherein the aqueous phase is dried to yield a lecithin having a water content of less than about 1 wt %.

19. Process according to claim 17 wherein the sludge portion or the aqueous phase is treated to yield a composition containing hydrolysed lecithin.

20. Process according to claim 19 wherein the sludge portion or the aqueous phase is enzymatically treated.

21. Process according to claim 20 wherein the pH of the sludge portion or the aqueous phase is raised to between 7 and 9 and the sludge portion or the aqueous phase is contacted with a phospholypase A2.

22. Process according to claim 19 wherein the aqueous phase containing the hydrolysed lecithin is dried to a water content of less than 1 wt %.

23. Process according to claim 19 wherein the hydrolysed phosphatide admixed with the oil comprises the said hydrolysed lecithin.

24. Process according to claim 17 wherein an acid or an acid anhydride, having a pH of at least 0.5 as measured in a molar aqueous solution at 20° C., is dispersed in the oil, 0.2 to 5% water by weight of oil is dispersed in the mixture so obtained and the resulting mixture is maintained for at least 5 minutes at a temperature below 40° C. prior to separation into an oil portion and a sludge portion.

25. Process according to claim 1 wherein the triglyceride oil is selected from the group comprising sunflower oil, safflower oil, soyabean oil, cottonseed oil, grapeseed oil, corn oil, rapeseed oil, rice bran oil, tallow and fish oil and mixtures thereof.

* * * * *